US011168679B2

(12) United States Patent
Wichern et al.

(10) Patent No.: US 11,168,679 B2
(45) Date of Patent: Nov. 9, 2021

(54) COMPRESSOR, COMPRESSED AIR SUPPLY FACILITY FOR OPERATING A PNEUMATIC SYSTEM, AND METHOD FOR OPERATING A COMPRESSED AIR SUPPLY FACILITY

(71) Applicant: WABCO GMBH, Hannover Niedersachsen (DE)

(72) Inventors: Jonas Wichern, Hannover (DE); Klaus Bredbeck, Landesbergen (DE); Uwe Stabenow, Laatzen (DE)

(73) Assignee: ZF CV SYSTEMS EUROPE BV, Brussels (BE)

( * ) Notice: Subject to any disclaimer, the term of this patent is extended or adjusted under 35 U.S.C. 154(b) by 69 days.

(21) Appl. No.: 16/497,816

(22) PCT Filed: Apr. 6, 2018

(86) PCT No.: PCT/EP2018/058829

§ 371 (c)(1),
(2) Date: Sep. 26, 2019

(87) PCT Pub. No.: WO2018/197182

PCT Pub. Date: Nov. 1, 2018

(65) Prior Publication Data

US 2020/0102947 A1 Apr. 2, 2020

(30) Foreign Application Priority Data

Apr. 28, 2017 (DE) ..... 10 2017 004 088

(51) Int. Cl.
*F04B 39/12* (2006.01)
*F04B 39/00* (2006.01)

(52) U.S. Cl.
CPC ..... *F04B 39/128* (2013.01); *F04B 39/0022* (2013.01); *F04B 39/0094* (2013.01)

(58) Field of Classification Search
None
See application file for complete search history.

(56) References Cited

U.S. PATENT DOCUMENTS 1,399,151 A * 12/1921 Putnam ..... F04B 39/128 417/254
2,751,144 A * 6/1956 Troendle ..... F01L 25/063 417/404

(Continued)

FOREIGN PATENT DOCUMENTS

DE 2945727 A1 7/1980
DE 3702547 A1 8/1988

(Continued)

*Primary Examiner* — Peter J Bertheaud
*Assistant Examiner* — Geoffrey S Lee
(74) *Attorney, Agent, or Firm* — Leydig, Voit & Mayer, Ltd.

(57) ABSTRACT

A compressor for a compressed-air feed of a compressed-air supply installation, for operating a pneumatic installation, includes: a first compression space; a second compression space; an air feed port; a compressed-air outlet; and a piston having a first face side, which is subjectable to pressure and which is directed toward the first compression space, and a second face side, situated opposite the first face side, which is subjectable to pressure and which is directed toward the second compression space, the first compression space being delimited by the first face side and the second compression space being delimited by the second face side. The first face side includes a full side and the second face side includes a step side. The piston is attached via a connecting rod to a drive. The first compression space and the second compression space are connected to one another via a connecting line.

20 Claims, 5 Drawing Sheets

(56) References Cited

U.S. PATENT DOCUMENTS

| | | | | |
|---|---|---|---|---|
| 4,540,352 | A * | 9/1985 | Becker | F04B 53/143 417/571 |
| 5,493,953 | A * | 2/1996 | Bolthouse | F04B 39/0005 384/11 |
| 10,040,229 | B2 | 8/2018 | Sommer et al. | |
| 2010/0192764 | A1* | 8/2010 | Ries | F02B 75/287 91/535 |
| 2015/0114217 | A1* | 4/2015 | Howes | F16J 10/02 92/172 |
| 2017/0254322 | A1 | 9/2017 | Oppermann | |

FOREIGN PATENT DOCUMENTS

| | | | |
|---|---|---|---|
| DE | 10302690 | A1 | 8/2004 |
| DE | 102008031848 | A1 | 1/2010 |
| DE | 102010054710 | A1 | 6/2012 |
| DE | 102011121750 | A1 | 6/2013 |
| DE | 102012019618 | A1 | 4/2014 |
| DE | 102012223114 | A1 | 6/2014 |
| DE | 102013101110 | A1 | 8/2014 |
| DE | 102014013442 | A1 | 3/2016 |
| GB | 241907 | A | 4/1926 |
| JP | 2014139442 | * | 7/2014 |
| SU | 1290026 | * | 2/1987 |

* cited by examiner

COMPRESSOR, COMPRESSED AIR SUPPLY FACILITY FOR OPERATING A PNEUMATIC SYSTEM, AND METHOD FOR OPERATING A COMPRESSED AIR SUPPLY FACILITY

CROSS-REFERENCE TO PRIOR APPLICATIONS

This application is a U.S. National Phase application under 35 U.S.C. § 371 of International Application No. PCT/EP2018/058829, filed on Apr. 6, 2018, and claims benefit to German Patent Application No. DE 10 2017 004 088.5, filed on Apr. 28, 2017. The International Application was published in German on Nov. 1, 2018 as WO 2018/197182 under PCT Article 21(2).

FIELD

The invention relates to a compressor, in particular compression blower, for a compressed-air feed of a compressed-air supply installation, for operating a pneumatic installation. The invention furthermore relates to a compressed-air supply installation for operating a pneumatic installation, to a method for operating a compressed-air supply installation, and to a vehicle having a compressed-air supply installation.

BACKGROUND

Compressors, in particular piston-type compressors, in vehicles of all types are well-known. They serve for the provision of compressed air and cover many fields of use, inter alia brake installations, air spring installations, in particular for ride-height control, clutch boosters and many others.

Important target criteria in the design of compressors are inter alia the highest possible delivery performance, the least possible generation of noise, the smallest possible dimensions, low outlay for production, and a high level of robustness.

DE 10 2012 019 618 A1 has disclosed a production method for a piston having a circumferential seal in the form of a circular cup seal, in particular for use in a pendular-piston compression blower.

DE 10 2011 121 750 A1 has disclosed, by way of example, a compression blower comprising a piston, the piston head of which is rigidly connected to a connecting rod, wherein a connecting-rod eye of the connecting rod is mounted rotatably on an eccentric journal of a drive shaft of a drive motor.

The approach of the rigid connection between connecting rod and piston nevertheless leads, owing to the structurally induced wobbling movement, to leaks between piston and cylinder, which should be counteracted by means of corresponding structural measures, for example seals.

DE 10 2013 101 110 A1 discloses a reciprocating-piston compressor having a piston which is driven by means of a crank drive and having a piston which is movable in reciprocating fashion in a cylinder and which is sealed off with respect to the cylinder wall and which is arranged so as to be static with respect to the connecting-rod axis, wherein the piston and/or the cylinder are designed such that the sickle-shaped gaps that arise between piston edge and cylinder wall during the compression stroke owing to the relative inclination or tilting between piston and cylinder can be sealed off, and leaks are thus compensated.

The concept of a two-stage compressor, in which the fed air is firstly compressed to a low pressure level in a low-pressure stage and is subsequently compressed to a high pressure level in a high-pressure stage connected to the low-pressure stage, is well proven.

For improved compactness, a two-stage compressor may be designed such that both compressor stages are formed by only one piston, for example by means of a piston which can be subjected to pressure on two sides.

For example, GB 241,907 discloses a multi-stage compression blower which, by means of a piston which comprises any desired number of step portions and a cylinder designed correspondingly thereto, can realize any desired number of compressor stages.

Furthermore, DE 10 2010 054 710 A1 discloses a compression blower for a compressed-air feed of a compressed-air supply installation, which compression blower has at least one two-stage compressor unit with a single cylinder with a single piston which, in a compression space of the cylinder, can be subjected to pressure on two sides.

In DE 10 2012 223 114 A1, a double-piston compression blower unit is furthermore described. A drive shaft of the motor of the compression blower unit interacts, by means of a sliding-block guide in the double piston of the unit, with said double piston such that the double piston performs a compression process alternately in the two cylinders of the unit. Here, the axis of the drive shaft is arranged eccentrically with respect to the central axis of the two cylinders, resulting in fewer changes in position of the piston and thus reduced noise generation.

The concept has room for improvement with regard to the above-stated disadvantages and target criteria. It is therefore desirable to realize the function of a high-performance, in particular two-stage, compressor in as compact and robust a design as possible.

SUMMARY

In an embodiment, the present invention provides a compressor for a compressed-air feed of a compressed-air supply installation, for operating a pneumatic installation, comprising: a first compression space; a second compression space; an air feed port; a compressed-air outlet; and a piston having a first face side, which is subjectable to pressure and which is directed toward the first compression space, and a second face side, which is situated opposite the first face side and which is subjectable to pressure and which is directed toward the second compression space, the first compression space being delimited by the first face side and the second compression space being delimited by the second face side, wherein the first face side comprises a full side and the second face side comprises a step side, wherein the piston is attached via a connecting rod to a drive, wherein the first compression space and the second compression space are connected to one another via a connecting line, wherein the connecting rod is connected rigidly at a piston side to the piston and, at a drive side, is connected rotatably to a rotating part of the drive, and wherein the piston bears, on the step side, on at least one seal which seals off the first compression space and/or the second compression space.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
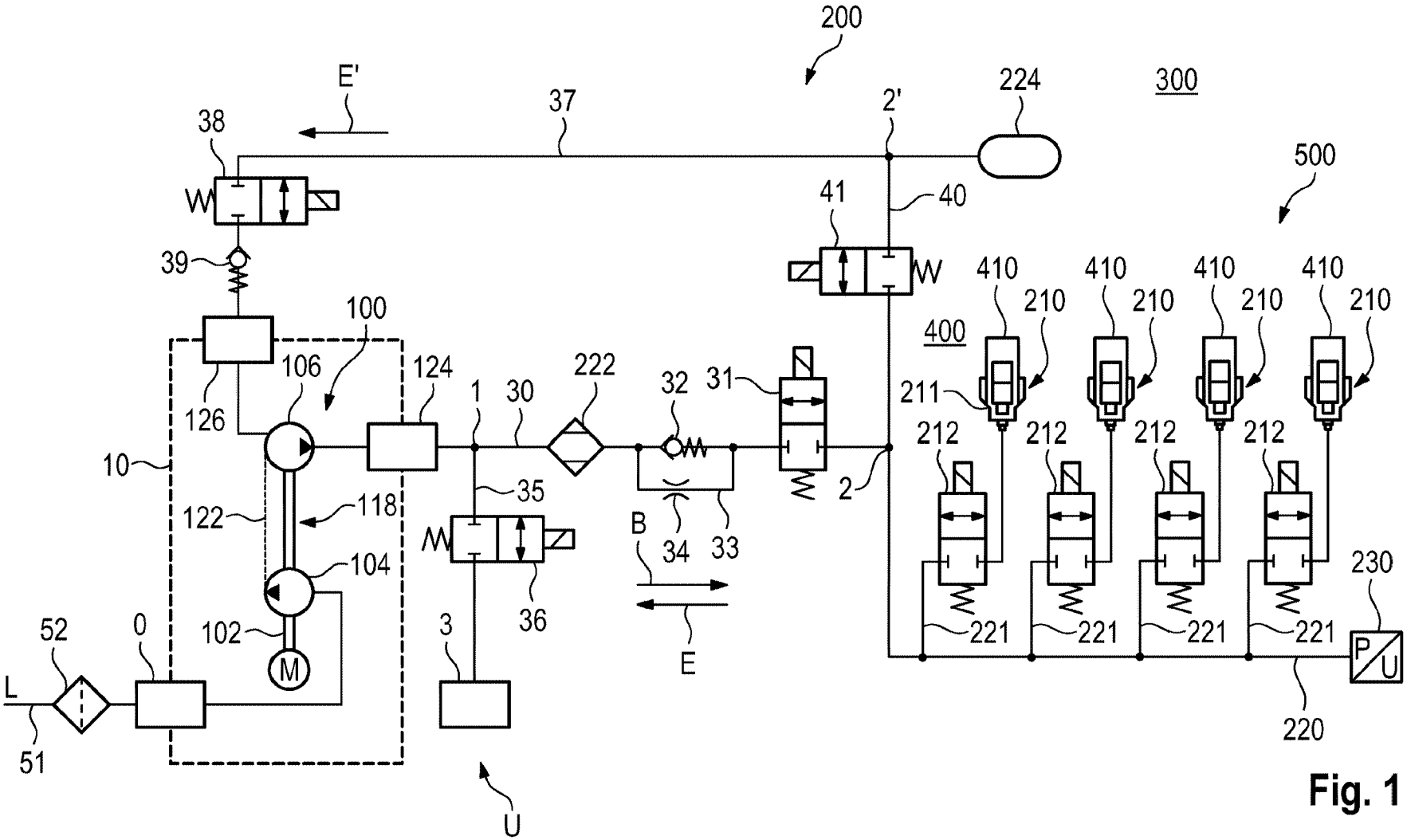
FIG. 1 shows a pneumatic circuit diagram of a pneumatic system having a particularly preferred embodiment of a compressed-air supply installation.

In an embodiment, the present invention provides, in an improved manner, a compressor which at least partially satisfies the above-stated aims and target criteria, in particular by means of a simplified structural design.

The invention proceeds from a compressor, in particular compression blower, for a compressed-air feed of a compressed-air supply installation, for operating a pneumatic installation, comprising:

a first compression space, a second compression space, an air feed port and a compressed-air outlet, and a piston having a first face side, which can be subjected to pressure and which is directed toward the first compression space, and having a second face side, which is situated opposite the first face side and which can be subjected to pressure and which is directed toward the second compression space, wherein the first compression space is delimited by the first face side and the second compression space is delimited by the second face side of the piston, wherein the first face side is a full side and the second face side is a step side, and the piston is attached via a connecting rod to a drive, and wherein the first compression space and the second compression space are connected to one another via a connecting line.

According to the invention, provision is made whereby the connecting rod is connected rigidly, in particular rigidly and without articulation, at a piston side to the piston and, at a drive side, is connected rotatably to a rotating part of the drive, and the piston bears, on the step side, at least one seal which seals off the first compression space and/or the second compression space.

The connecting rod may preferably be connected rigidly, in the sense of rigidly and without articulation, at a piston side to the piston. One approach for simplifying the construction of the compressor consists in the rigid connection of connecting rod and piston and the associated acceptance of a certain wobbling movement of the piston during the stroke.

Such compressors, also referred to as wobbling-piston compression blowers or pendular-piston compression blowers, lead to the advantage that fewer moving parts have to be used for the coupling of drive and piston, and it may even be the case that no guide elements are required for the piston for the purposes of accommodating lateral forces introduced by the connecting rod.

The invention proceeds from the consideration that single-stage wobbling-piston compressors have advantages with regard to their simple structural design. These include in particular lower susceptibility to failure, a relatively small number of parts and assemblies, and easier maintenance and repair. At the same time, however, construction-induced problems arise which are attributable in particular to the wobbling movement, that is to say the relative inclination between piston axis and cylinder axis in dependence on the stroke. These problems, in particular the not purely translational reciprocating movement of the piston, are counteracted in the prior art by structural measures, in particular suitable seals.

The invention furthermore proceeds from the consideration that a two-stage compressor with only both a single piston and a single cylinder leads to major advantages with regard to the reduction of parts, in particular moving parts, and thus a more compact design of the compressor. At the same time, challenges exist in the case of this compressor concept too, including in particular the accommodation of lateral forces in order to ensure the translational reciprocating movement of the piston which can be subjected to pressure on both sides, and thus in particular the sealing of the two compression spaces that are separated by the piston. Through the use of suitable guides and bearings, a purely translational reciprocating movement of the piston and of the piston rod, which are driven in particular by a crankshaft, can be ensured.

The invention has surprisingly identified that the combination of these two supposedly contradictory compressor concepts, specifically that of the wobbling-piston compressor and that of the two-stage, single-piston compressor, is possible and leads to the major advantages of the two approaches as already mentioned above. Contrary to the widely held view in the prior art that the sealing of the two compression spaces in the case of a two-stage, single-piston compressor can be ensured only in the case of a purely translational stroke movement, the invention is based on the consideration that the construction-induced wobbling movement can be counteracted by means of corresponding structural measures, in particular seals.

Here, the invention has in particular recognized that, in the case of a corresponding, in particular cylindrical or annular cylindrical form of the first and second compression spaces, in particular together with a piston which can be subjected to pressure on both sides, can be realized with only one seal.

In particular, provision is made whereby the piston comprises a check valve which opens automatically, counter to a spring force, from the first compression space in the direction of the air feed port.

Specifically, this check valve may be arranged in an opening at the full side and thus between the first compression space and the air feed port, or the air inlet region that is open to the surroundings. "Surroundings" means in particular the crankcase interior space, which is at a relatively low pressure. In particular, by means of a gas-conducting connection out of the crankcase interior space, in particular an opening, line, valve and/or the like, between the crankcase interior space and a location situated outside the crankcase, it can be achieved that the crankcase interior space is practically at ambient pressure, that is to say at the pressure of the atmosphere surrounding the crankcase and in particular also the vehicle.

The check valve can thus automatically open, in particular in order to prevent damage, in the presence of a pressure in the first compression space which is elevated in relation to the normal level.

Furthermore, the integration of the check valve into the piston leads to the advantage that the valve can be exchanged, or dismounted and/or repaired, together with the piston. Altogether, the invention has recognized that an integration of the moving and/or wearing parts of the compressor into the piston, in particular valve flaps, check valves and seals, leads to the advantageous effect of easier accessibility and/or exchangeability.

In a preferred refinement, provision is made whereby the connecting rod is rotatably connected to the rotating part of the drive in the form of an eccentrically arranged shaft portion. In this way, the rotational movement of the drive is converted into a wobbling movement which has predominantly translational movement components.

Provision is advantageously made whereby the connecting rod is formed as a single piece and without articulation with respect to the piston. This includes the rigid connection between piston and connecting rod in particular without articulations which compensate relative inclinations. In this way, the construction and the production of the compressor are simplified, and the number of moving parts is reduced. This in turn advantageously leads to reduced susceptibility to failure, and reduced outlay for repair and maintenance.

In particular, provision is made whereby the first compression space is of cylindrical form or is of cylindrical form with a dome-shaped portion, and the second compression space is of annular cylindrical form.

Specifically, this embodiment may be formed by a rotationally symmetrical cylinder inner web which is arranged within the cylinder and which has an L-shaped cross section and which is open in the direction of the piston and thus forms an annular cylindrical compression space. Here, the expression "annular cylindrical" describes a compression space which, by contrast to the first compression space, is of not fully cylindrical but rather hollow cylindrical form, that is to say has an inner cylindrical lateral surface and an outer cylindrical lateral surface. By means of the reciprocating movement of the piston, the step side of the piston is moved in oscillating fashion within the annular compression space in order to generate the compression.

This annular form of the compression space leads to the advantage that said compression space can be sealed by means of only one seal, which is attached in particular to the piston. Also, by contrast to other approaches in the prior art involving two-stage, single-piston compressors, this annular form of the compression space avoids a situation in which further moving parts, in particular connecting rods or piston rods, directly adjoin the compression space and thus have to additionally be sealed off.

Furthermore, by means of a dome-shaped portion or generally a profile which tapers toward the full side of the piston, a piston form can be realized which advantageously does not become jammed in the cylinder despite a wobbling movement.

In a preferred refinement, provision is made whereby the at least one seal of the piston effects pressure-tight sealing, which acts in a radial direction, both against an outer side and against an inner side, and is formed in particular as a single seal. Here, the single seal may be formed for example as a sleeve-type seal.

In such an embodiment, the sealing both of the compression spaces with respect to one another and of the compression spaces from the surroundings is realized by means of only one seal, which seals off in a radial direction at both sides, that is to say both to the inside and the outside. This refinement leads to the advantage that, through the use of a small number of seals, in particular only a single seal, for sealing off the annular compression space, in particular both compression spaces, the construction of the compressor is simplified, and thus costs are reduced and the number of parts, in particular wearing parts, is reduced. Also, the arrangement of the seal on the step side of the piston leads to simple production and assembly of piston and seal.

In a preferred refinement, provision is made whereby the seal is designed to seal off the second compression space with respect to a crankcase interior space and to seal off the first compression space with respect to the second compression space.

Provision is advantageously made whereby the outer side of the seal is in encircling contact with a cylinder inner wall, and the inner side of the seal is in encircling contact with a web wall inner side. Specifically, this may include the seal having an outer side and an inner side. The outer side of the seal is in this case arranged at the outer circumference, that is to say the outer side of the—in simplified terms—annular seal, and thus produces encircling, continuous contact with a cylinder inner wall, which in particular forms a cylindrical cavity. The inner side of the seal is arranged at the inner side, that is to say at the inner circumference of the—in simplified terms—annular seal, and thus produces encircling, continuous contact with a web wall inner side.

In one refinement, provision is made whereby the seal comprises an annular seal body with a first annular lip radially at the outside on the annular body and with a second annular lip radially at the inside on the annular body.

In one refinement, provision is made whereby the seal comprises an annular seal body having a first annular lip, which is arranged in a radial direction at the outside on the seal body so as to be directed in an axial direction toward the second compression space, and/or a second annular lip, which is arranged in the radial direction at the inside on the seal body so as to be directed in the axial direction toward the second compression space. The first and/or second annular lip has in particular a free end which is arranged in the second compression space.

Such a refinement includes in particular a first expansion space being formed between the first annular lip and a main body of the seal body, and a second expansion space being formed between the second annular lip and the main body.

By means of the first and second expansion spaces, it is realized that compressed air situated in the second compression space pushes both the first annular lip and the second annular lip against the cylinder inner wall and thus effects a sealing action. Here, a first sealing action is effected between the first annular lip and a wall outer side of the cylinder inner wall, and a second sealing action is effected between the second annular lip and a wall inner side of the cylinder inner wall.

A refinement with a seal body of said type may be used in particular if a compressor is used in two-stage operation. Two-stage operation includes in particular the compressed air initially being compressed in the first compression space to a relatively low pressure, for example 3 bar, and subsequently being compressed in the second compression space to a relatively high pressure, for example 22 bar. In such an operating mode, the first pressure in the first compression space assumes for example a value of at most 3 bar, and the second pressure in the second compression space assumes for example a value between 3 bar and 22 bar.

In one refinement, provision is made whereby the annular seal body comprises a third annular lip which is arranged in the radial direction at the outside on the seal body so as to be directed in the axial direction toward the first compression space. The third annular lip has in particular a free end which is arranged in the first compression space.

In such a refinement, a third sealing action between the third annular lip and the wall outer side of the cylinder inner wall is advantageously effected, in particular by means of a third expansion space. By means of the third sealing action, it is advantageously realized that a sealing action between the first compression space and the second compression space is effected independently of the pressures prevailing in the first and second compression spaces. In particular if the first pressure prevailing in the first compression space is equal to or higher than the second pressure prevailing in the second compression space, an overflow of compressed air from the first compression space into the second compression space is prevented by the third annular lip. In this way, single-stage operation of the compressor is advantageously made possible, in which compressed air is compressed to the same final pressure in the first compression space and in the second compression space. In such an operating mode, compressed air is compressed to the same final pressure of for example 18 bar in both compression spaces. Thus, in such an example, both the first pressure in the first compression space and the second pressure in the second compression space assume a value of at most 18 bar.

In a preferred refinement, provision is made whereby the piston has a non-cylindrical outer cross section which varies in the axial direction. Specifically, this means for example that the outer cross section of the piston is of elliptical form at the upper and lower ends of the piston and is of circular form at a location between the upper and the lower end of the piston, that is to say the piston outer wall is not cylindrical.

Provision is advantageously made whereby the piston has a non-cylindrical inner cross section which varies in the axial direction. Specifically, this may mean that the inner cross section is of elliptical form at the upper and lower ends of a piston step which forms the annular part of the piston, and is of circular form at a location between the upper and the lower end of the piston step, that is to say the piston inner wall is not cylindrical.

Both abovementioned refinements lead to uniform sealing of the compression spaces, which is independent of the wobbling movement and thus relative inclination between cylinder and piston. By means of the variable shape of the piston outer wall, it is ensured that the outer cross section of the piston in a plane perpendicular to the axis of the cylinder remains practically invariant, and in particular congruent with the cylinder inner cross section, in every stroke position. The same aspect applies analogously to the piston inner wall with regard to the sealing against the rotationally symmetrical cylinder inner web with L-shaped cross section, which forms the second compression space.

Furthermore, in a further embodiment, in particular with a seal which simultaneously forms the largest outer cross section and the smallest inner cross section of the piston, such a refinement can advantageously be achieved in that the piston is in contact with the inner wall and with the web wall of the cylinder only via the seal. In this way, it is advantageously achieved that, by means of this practically only linear contact in an only narrow axial region of the piston, low-friction sealing of the compression spaces with respect to one another and with respect to the surroundings is realized. In this way, the risk of jamming of the piston in the cylinder is likewise advantageously reduced, despite the wobbling movement.

In a preferred refinement, provision is made whereby the second compression space furthermore comprises a charging port for the additional feed of compressed air, in particular from a pressure medium reservoir. In this way, air that has already been pre-compressed and stored can be fed to the second compression space when required. Such an approach permits the temporary storage of compressed air in order, in non-full-load operating phases, for air to be compressed already from the outset to a particular (intermediate) high pressure by means of the compressor, and for this pre-compressed air to be retrieved, and/or compressed further, at a later point in time. In this way, the power of the compressor can be quickly increased.

In particular, provision is made whereby the air feed port is arranged within the connecting rod and/or the piston. This refinement of the compressor leads, analogously to the refinement relating to the check valve integrated into the piston, in particular to an integration of components and functional features into an easily accessible and exchangeable component, in this case the piston, and thus to advantages in particular with regard to increased modularity through the use of standardized components and reduced outlay for maintenance and repair.

Provision is advantageously made whereby the rotatable connection between connecting rod and eccentrically arranged shaft portion is formed by means of a connecting-rod bearing, in particular a plain bearing, ball bearing or needle-roller bearing. What is particularly advantageous is a low-maintenance, particularly preferably maintenance-free, design of the rotatable connection. This may be realized for example through the use of plain bearings.

To achieve the object, the invention furthermore provides a compressed-air supply installation having an abovementioned compressor, and a method for operating a compressed-air supply installation.

The compressed-air supply installation is designed for operating a pneumatic installation and comprises:

an air feed and a compressor according to the invention which is connected to said air feed via an air feed port, a pneumatic main line, which is pneumatically connected to the compressor via a compressed-air outlet and which comprises an air dryer, to a compressed-air port of a gallery, a pressure medium reservoir which is pneumatically connected to the compressor via a charging port.

According to the invention, the compressor is designed in accordance with the invention.

The operation of the pneumatic installation is configured in particular for the supply of compressed-air consumers in a vehicle, in particular for the supply of air spring installations.

To achieve the object, the invention furthermore provides a method having an above-stated compressor for operating a compressed-air supply installation, and a method for operating a compressed-air supply installation, and a vehicle having a compressed-air supply installation. The method for operating a compressed-air supply installation comprises the steps: compressing air from a crankcase interior space and/or from the surroundings to a low pressure level in a first compression space of the compressor, further compressing the compressed air that has been compressed to a low pressure level in the first compression space to a high pressure level in a second compression space of the compressor, and feeding the compressed air that has been compressed to a high pressure level in the second compression space from the compressed-air outlet via a pneumatic main line to a compressed-air port of a gallery, in particular via an air dryer. In the method, the advantages of the compressor are advantageously utilized. In the vehicle and in the compressed-air supply installation, it is likewise possible for the advantages, in particular the advantages of the compressor according to the concept of the invention, to be advantageously utilized. These include in particular the compact structural form, which arises owing to a two-stage, single-piston wobbling-piston compressor according to the concept of the invention, and leads in particular to a reduction of installation space and weight, which is advantageous for vehicles.

Compressors according to the concept of the invention are preferably used in a compressed-air supply installation—particular demands have arisen here with regard to compression power and compactness. However, a compressor according to the concept of the invention may be used for other types of compressed-air sources. A compressed-air supply installation is, by way of example, illustrated as a preferred embodiment in FIG. 1 and described below.

It should however be clear that the compressor according to the concept of the invention may be used not only preferably in compressed-air supply installations or for the passenger motor vehicle or utility vehicle sector. Applications for negative-pressure generators, in particular vacuum pumps, have also arisen.

FIG. 1 shows a pneumatic system 300 having a compressed-air supply installation 200 and having a pneumatic installation 500 which, in the present case, is in the form of an air spring installation of a vehicle 400 which is not illustrated in any more detail.

In the present case, the air spring installation is formed with an exemplary number of four air springs 210, wherein each air spring 210 is assigned to a wheel of a vehicle 400 which is not illustrated in any more detail. In the present case, of the vehicle 400, there is merely symbolically illustrated a bearing 410 which is formed in the vicinity of a wheel and which can be raised when the air spring 210 is filled and lowered when the air spring 210 is ventilated. An air spring 210 comprises an air bellows, referred to here as bellows 211, for receiving compressed air, and an air spring valve 212, which holds the compressed-air quantity in the bellows 211 or releases said compressed-air quantity and permits filling of the bellows 211 with compressed air.

The air spring valve 212 is formed as a controllable solenoid valve, in this case as a 2/2 directional valve. In the present case, each of the air spring valves 212 is shown in an in an electrically deenergized state in which it is closed by the spring force of a spring (not designated in any more detail).

The air spring valves 212 are connected to a gallery line 220, formed as a manifold line, via suitable spring branch lines 221. Directly connected to the gallery line 220 is a stress-pressure sensor 230 which is capable of measuring a pressure in the gallery line 220 and, with suitable switching of the air spring valves 212, also a pressure in the air springs 210. The stress-pressure sensor 230 may also, in conjunction with an accumulator system, specifically in the present case the accumulator 224, the pneumatic line 40 and the accumulator valve 41, measure an accumulator pressure. Pressure sensor signals may, for the initiation of further control measures, be transmitted to an air spring controller and/or to a vehicle controller, which is not illustrated in any more detail here. In the present case, the pneumatic system 500 in the form of the air spring installation is supplied with compressed air from the compressed-air supply installation 200.

The pneumatic installation 500 is, for this purpose, connected via a compressed-air port 2 to the compressed-air supply installation 200. Compressed air from a compressed-air feed line 10 with a compressor 100 can be fed via a pneumatic main line 30 to the compressed-air port 2. Compressed air can also be fed to the compressed-air port 2 from a pressure medium reservoir 224 by a further compressed-air port 2' and a further pneumatic line 40.

The compressed-air supply installation 200 has isolating valves which are suitable for the expedient selection of the manner in which compressed air is fed to the pneumatic installation 500, specifically a first isolating valve 31 in the pneumatic main line 30 and a second isolating valve 41 in the further pneumatic line 40. The first and second isolating valves 31, 41 are each formed as a controllable solenoid valve—in this case as a 2/2 directional valve.

FIG. 1 shows the first and second isolating valves 31, 41 in each case in a closed state, such that the pneumatic installation 500 is completely separated from the compressed-air supply installation 200. This advantageously has the effect that an air dryer 222 of the compressed-air supply installation is not adversely affected (for example filled) as a result of compressed-air movements in the pneumatic installation 500, or transfer of compressed air from the pressure medium reservoir 224 into the pneumatic installation 500, when the first isolating valve 31 is closed.

Overall, the compressed-air supply installation 200 has a compressed-air feed 10 to which the pneumatic main line 30 is connected. The air dryer 222, at the compressed-air feed side, and the first isolating valve 31, at the compressed-air port side, are connected pneumatically in series in the pneumatic main line 30. Between the air dryer 222 and the first isolating valve 31, there is connected a valve arrangement designed as a pneumatic parallel circuit.

The valve arrangement has a check valve 32 which automatically opens in an aeration direction B toward the pneumatic installation 500 and which blocks in a ventilation direction E from the pneumatic installation 500 to the air dryer 222. In a pneumatic line connected in parallel, as a bypass line 33, with respect to the pneumatic main line 30, there is arranged a throttle 34 which, being capable of being flowed through bidirectionally, serves as a regeneration throttle. The throttle 34 has a nominal width sufficient to, during the ventilation of the pneumatic installation 500 with the first isolating valve 31 open, provide a pressure drop such that an air dryer 222 is sufficiently regenerated during the course of a pressure change adsorption.

A compressed-air flow conducted in the ventilation direction E can, via a ventilation line 35 connected to the pneumatic main line 30, be ventilated to a ventilation port 3 to the surroundings U. In the ventilation line 35, there is arranged a further isolating valve 36, which must be opened for a ventilation process. The further isolating valve 36 is, like the first and second isolating valves 31, 41, formed as a controllable solenoid valve, specifically in this case as a 2/2 directional valve.

It is also possible for a fundamentally different design of the pneumatic main line 30 and ventilation line 35 to be provided, for example with a suitable pilot-controlled ventilation solenoid valve arrangement or the like.

In the present case, the compressed-air feed 10 has a compressor 100 which is designed in accordance with the concept of the invention and which will be described below on the basis of the particularly preferred embodiment illustrated by way of example in FIG. 1, FIG. 2A and FIG. 2B. The compressor 100 of the compressed-air feed 10 is formed with the compressed-air feed 10 in the present case as a device which is separately connectable to the compressed-air supply installation 200. The component, which can thus be referred to as compressed-air feed device, of the compressed-air feed 10 has a compressed-air outlet 124, to which the pneumatic main line 30 of the compressed-air supply installation 200 is connectable. Furthermore, the compressed-air feed 10 has a charging port 126, to which a pneumatic line 37 to the pressure medium reservoir 224 is connectable via a yet further isolating valve 38. The pressure medium reservoir 224 is attached to the pneumatic line 37 via the abovementioned second compressed-air port 2'. Also connected to the second compressed-air port 2' is the further pneumatic line 40 to the compressed-air port 2.

When the yet further isolating valve 38 is open, the pneumatic line 37 can be flowed through only unidirectionally by compressed air, specifically in a further ventilation direction E' as viewed from the pressure medium reservoir 224. For this purpose, the pneumatic line 37 has a further check valve 39 which automatically opens in the further ventilation direction E' and blocks in the opposite direction. The pneumatic line 37 is thus designed to feed compressed air from the pressure medium reservoir 224 to the charging port 126 of the compressed-air feed 10 when the yet further isolating valve 38 opens.

Furthermore, the compressed-air feed 10 has an air feed port 0, via which air from an air feed L—filtered in a filter 52 of an intake line 51—can be fed.

As can be seen from FIG. 1, the compressor 100 of the compressed-air feed 10 is designed to have a first compression space 104 and a second compression space 106. According to the concept of the invention, in the embodiment described here, the compressor 100 is designed to have a single cylinder 118, as described in more detail in FIGS. 2A and 2B. A single piston 112 of the compressor 100, which can be subject to pressure on both sides in the interior space of the cylinder 118, is driven so as to perform movement by a motor M via a drive shaft 102. The cylinder 118 with piston 112 of the compressor 100 is, in the present case, arranged so as to form the two compression spaces 104 and 106 on a single side of the motor M. As can be seen from the description of FIG. 2A and FIG. 2B, this is a particularly compact arrangement of the cylinder 118 utilizing a single piston 112.

The compressed-air feed or the compressor 100 has a connecting line 122 between the first compression space 104 and the second compression space 106.

The connecting line 122 is formed as a leadthrough of a piston body of the piston 112 and is thus of particularly compact design. Owing to the relatively short connecting line 122, the entire compression space in the cylinder 118 is kept small, such that a particularly high compression amplitude can be achieved.

The availability of compressed air, that is to say in particular a compressed-air flow rate, can possibly be yet further increased by virtue of further pressure medium being fed to the second compression space 106 via the second, optionally usable charging port 126 and—in so-called boost operation—being compressed further together in the second compression space 106 with the compressed air, which has been compressed to a high level, of the first compression space 104 and being made available at the compressed-air outlet 124.

For such a compressor 100, various embodiments which follow the concept of the invention will be illustrated below, for which further fields of use are conceivable aside from the application illustrated in FIG. 1.

Figure 2B:
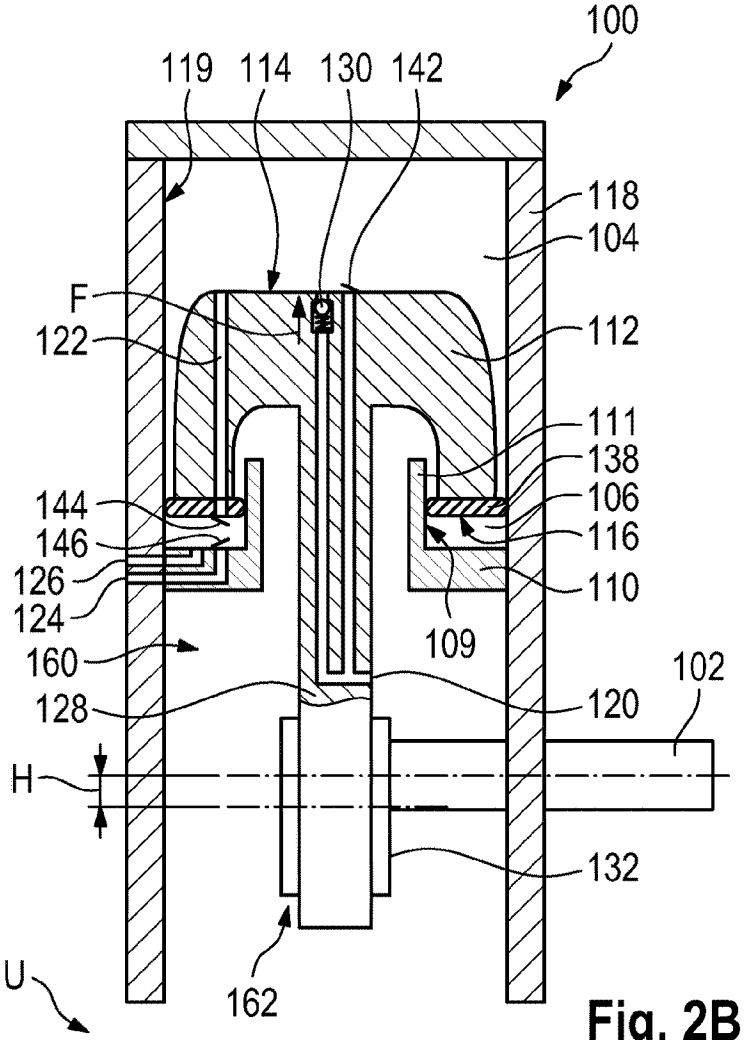
FIG. 2B is a schematic sectional illustration of a compressor according to the embodiment in a section plane parallel both to the drive axis and to the piston axis.
Figure 2A:
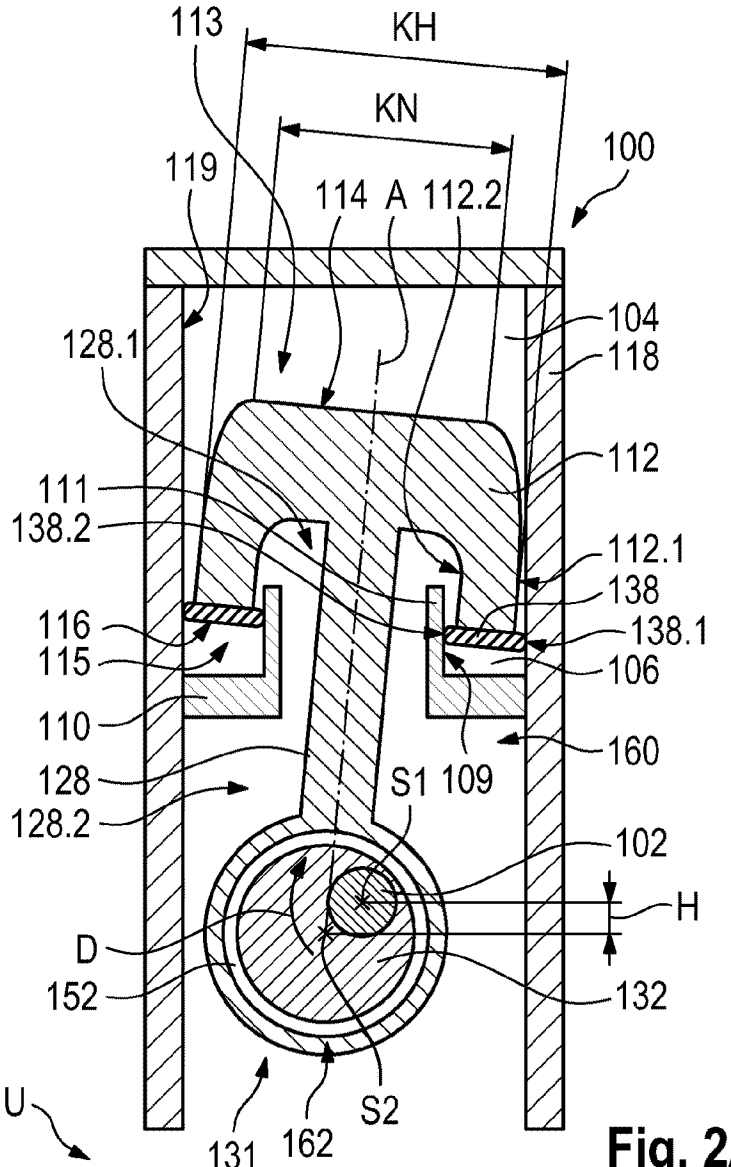
FIG. 2A is a schematics sectional illustration of a compressor according to an embodiment in a section plane perpendicular to the drive axis.
Figure 3:
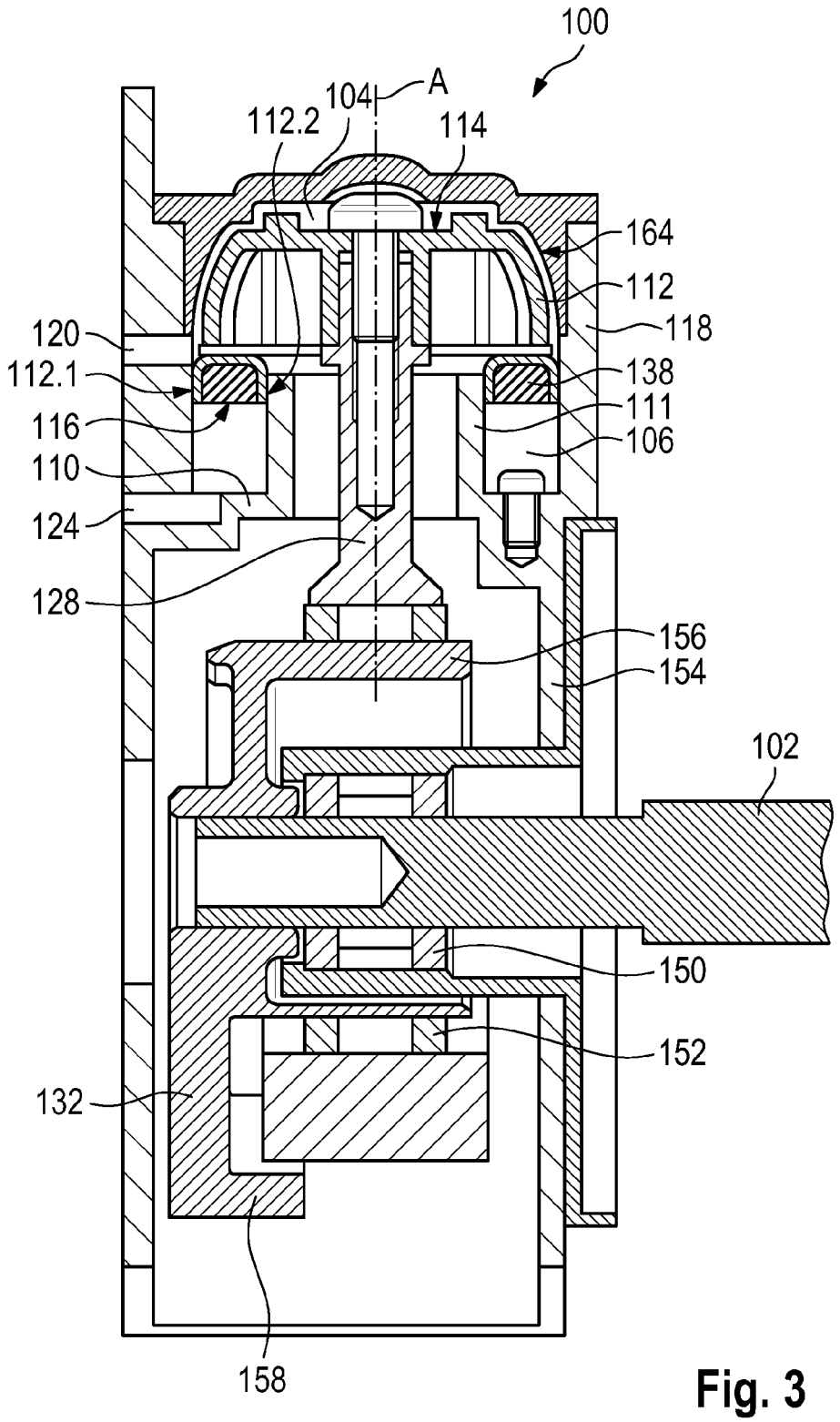
FIG. 3 is a sectional illustration of a compressor according to a further embodiment in the installed state.
Figure 4A:
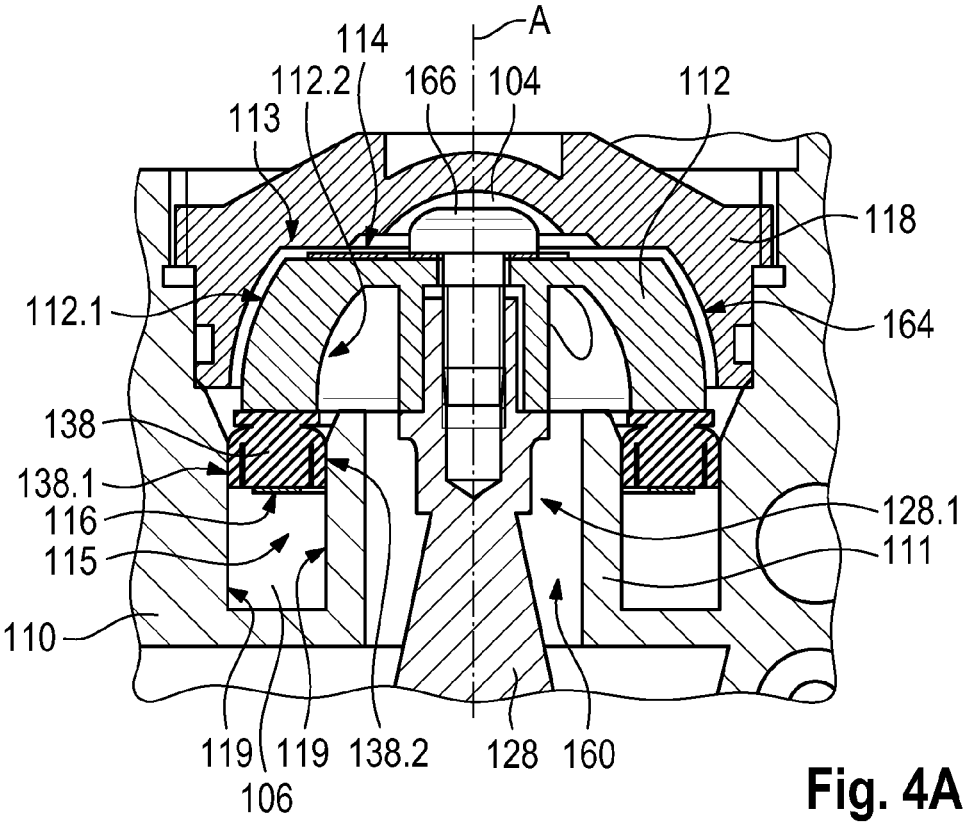
FIG. 4A shows a detail view of a piston of a yet further embodiment in a section plane perpendicular to the drive axis.
Figure 4B:
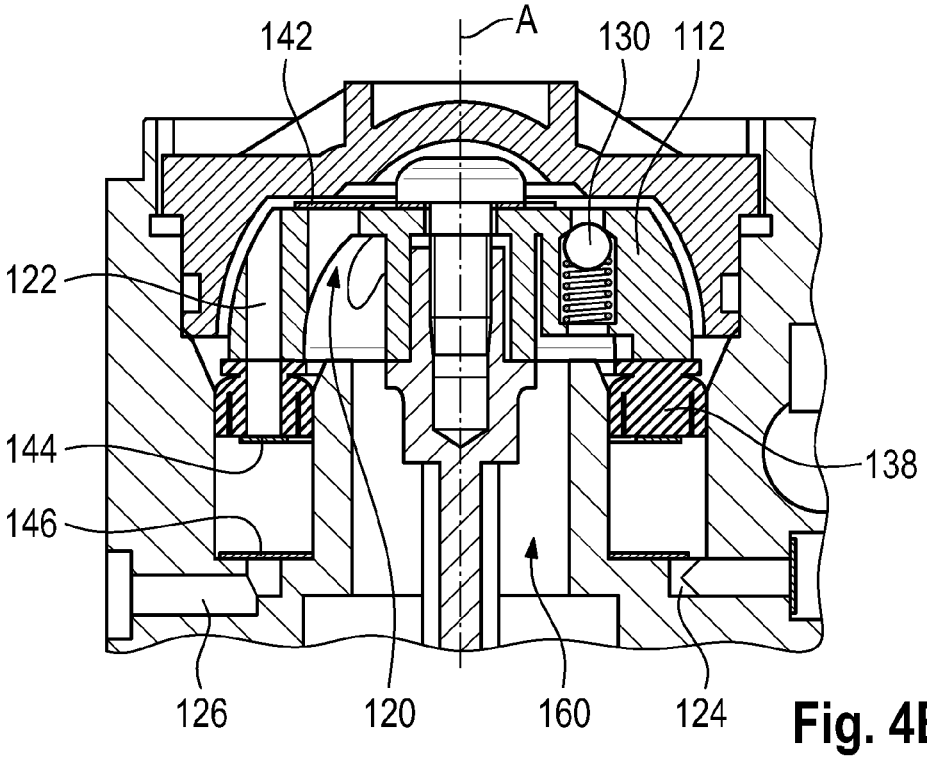
FIG. 4B shows a detail view of a piston of the yet further embodiment in a section plane parallel both to the drive axis and to the piston axis.

FIG. 2A shows a compressor 100 according to a preferred embodiment in a first sectional illustration. A piston 112 is arranged within a cylinder 118 in a cylindrical cavity. The piston 112 is, by means of a rigidly connected connecting rod 128, connected rotatably, by means of a rotatable connection 162 about an axis of rotation running perpendicular to the section plane through the point S2, to an eccentrically arranged shaft portion 132, which in turn is connected, for the transmission of drive movement, to a drive shaft 102. In the present case, piston 112 and connecting rod 128 are formed as a single piece, in particular are combined coaxially along a common piston axis A. The piston 112 is furthermore—like other regions in this view—illustrated in highly schematic form. In particular, the form of the piston 112 may deviate from the form shown here, in particular in order to realize functionally induced wobbling kinematics. Such deviating refinements are shown in FIG. 3, FIG. 4A and FIG. 4B.

In the present case, the rotatable connection 162 is realized by means of a connecting-rod bearing 152. The drive shaft 102 and the eccentrically arranged shaft portion 132 are part of a rotating part 131 of the drive. The connecting rod 128 has a piston side 128.1 facing toward the piston 112 and a drive side 128.2 facing toward the drive shaft 102.

The drive shaft 102 in turn performs a rotational movement D about an axis of rotation running perpendicular to the section plane through a point S1. By means of the rigid connection of the drive shaft 102 to the eccentrically arranged shaft portion 132, and by means of the offset of the two points S1 and S2, a rotational movement of the drive shaft 102 leads to a deflection H of the piston in the stroke direction.

Furthermore, within the cylindrical cavity enclosed by the cylinder 118, there is arranged a rotationally symmetrical cylinder inner web 110 which extends radially inward from the cylinder inner wall 119 and which has an L-shaped cross section. Owing to the L-shaped cross section, the cylinder inner web 110 has, at its inner side, a web wall 111 directed in the direction of the piston 112. Thus, by means of the inner wall of the cylinder 118 and of the cylinder inner web 110, an annular space which is open in the direction of the piston 112 is formed, which space constitutes the second compression space 106.

The piston 112 has, on the side averted from the connecting rod 128, a first face side 113 formed as a full side 114 which, together with the inner wall of the cylinder 118, delimits the first compression space 104. Furthermore, on the side facing toward the connecting rod 128, the piston 112 has an annular piston step which is formed in the manner of a hollow cylinder, the outer wall of which is congruent with the outer wall of the piston 112 at the level of the full side 114 and which, on that side of the piston 112 which is situated opposite the full side 114, is closed off by a second end side 115 formed as a step side 116.

Furthermore, the cylinder 112 is formed such that the piston 112, in particular the side which faces toward the connecting rod 128 and which has the step side 116, can move in oscillating fashion within the annular space formed by the cylinder inner web 110 and the inner wall of the cylinder 118. The second compression space 106 is formed owing to the delimitation of the practically annular space formed by cylinder inner web 110, inner wall of the cylinder 118 and step side 116.

The piston 112 furthermore has a seal 138, which in the illustrated embodiment is arranged at the face side on the step side 116 of the piston 112. The seal 138 leads to sealing of the second compression space 106 with respect to the first compression space 104 and of the compression spaces 104, 106 with respect to a crankcase interior space 160. For this purpose, the seal 138 has an outer side 138.1 and an inner side 138.2. The outer side 138.1 of the seal 138 is arranged at the outer circumference, that is to say the outer side, of the—in simplified terms—annular seal 138 and thus produces encircling, continuous contact with a cylinder inner wall 119, which forms in particular a cylindrical cavity. The inner side 138.2 of the seal 138 is arranged on the inner side, that is to say on the inner circumference, of the—in simplified terms—annular seal 138 and thus produces encircling, continuous contact with a web wall inner side 109. By means of the arrangement and form of the piston 112, of the cylinder 118 and of the cylinder inner web 110, it is thus possible to effect the sealing of both compression spaces 104, 106 by means of a relatively small number of seals, in particular only a single seal 138.

Also visible in FIG. 2A is the relative inclination of piston 112, and of the connecting rod 128 rigidly connected to the piston 112, with respect to the cylinder 118. This inclination is effected owing to the component perpendicular to the stroke direction of the offset between the axis of rotation, running through the point S1, of the drive shaft and the axis of rotation, running through the point S2, of the rotational movement between connecting rod 128 and eccentrically arranged shaft portion 132. This component perpendicular to the stroke direction of the offset is dependent on the angular position of the drive shaft 102 or of the eccentrically arranged shaft portion 132. At the top and bottom dead centers of the piston 112, when the deflection H in the stroke direction is at a maximum, the component perpendicular to the stroke direction of the offset is equal to zero. In the middle of the travel between the two dead centers of the piston 112, when the deflection H in the stroke direction is equal to zero, the component perpendicular to the stroke direction of the offset is accordingly at a maximum.

Owing to the relative inclination of the piston 112 and connecting rod 128 with respect to the cylinder 118, openings, in particular sickle-shaped gaps, form between the piston 112 and the inner wall of the cylinder 118 or cylinder inner web 110. Such openings lead to an escape of compressed air from the second compression space 106 into the first compression space 104 and/or into the surroundings U or into a crankcase interior space 160. To prevent this, or for the compensation of the wobbling movement of the piston 112, the seal 138 is designed correspondingly. This includes sufficient dimensioning, and elastic characteristics of the seal 138, such that sealing of the compression spaces 104 and 106 remains ensured even in the event of openings forming between piston 112 and cylinder 118 as a result of the wobbling movement.

FIG. 2B shows a further sectional illustration of a preferred embodiment of a compressor in a section plane parallel both to the drive axis and to the piston axis A. From the sectional illustration, it can be seen how air from the surroundings U or from the crankcase interior space 160 can pass into the first compression space 104 via an air feed port 120 arranged within the piston 112 and the connecting rod 128. Here, by means of an air feed valve flap 142 arranged on the full side 114 of the piston 112, it is ensured that air can only flow into, but not out of, the first compression space 104 via the air feed port 120. This is achieved in that, during the reduction in size of the first compression space 104, and the associated compression of the air situated therein, caused by the deflection H, the air feed valve flap 142 closes counter to the increasing pressure in the first compression space 104. Correspondingly, the air feed valve flap 142 opens during the increase in size of the first compression space 104 owing to the negative pressure in relation to the surroundings that prevails in the first compression space 104, such that air from the surroundings or the crankcase interior space 160 flows into the first compression space 104.

Furthermore, within the piston 112, as a further connection between the first compression space 104 and the air feed port 120 or the crankcase interior space 160, there is arranged a check valve 130 which is held in the closed state by a spring force F. By means of the check valve 130, it is thus possible for air in the first compression space 104 whose pressure exceeds a particular maximum value that is potentially damaging in particular to the compressor to escape into the surroundings via the air feed port 120. Alternatively, the check valve 130 may also be arranged such that the air escapes directly, that is to say without being conducted via the air feed port 120, into the crankcase interior space 160 or the surroundings U.

Furthermore, a connecting line 122 between the first compression space 104 and the second compression space 106 is arranged within the piston 112. Said connecting line 122 constitutes a gas-conducting connection of the two compression spaces 104 and 106 and, analogously to the air feed valve flap 142, has a connecting valve flap 144 which ensures that air flows only in one direction through the connecting line 122, specifically from the first compression space 104 to the second compression space 106. Accordingly, during the decrease in size of the second compression space 106, the connecting valve flap 144 closes counter to the increasing pressure, and, during the increase in size, said connecting valve flap opens, such that air can flow from the first compression space 104 into the second compression space 106. The air compressed in the second compression space 106 can be made available via a compressed-air outlet 124 to consumers of a pneumatic installation 500, in particular by a compressed-air supply installation 200.

Furthermore, in the cylinder 118, there is arranged a charging port 126 which leads to the second compression space 106 and which has a charging valve flap 146. Via the charging port 126, air which has for example been compressed at a preceding point in time and which is accumulated and stored in a pressure medium reservoir 224 can be fed to the second compression space 106. In this way, the power of the compressor 100 can be quickly increased, in particular in order to make compressed air available more quickly. The charging valve flap 146 ensures here that air flows exclusively into the second compression space 106 via the charging port 126, and cannot escape via the charging port 126.

Furthermore, the piston 112 does not have a cylindrical shape, but rather has a cross section which varies along a piston axis A. In this embodiment, the piston 112 has, at the level of the full side 114, a cross section with a piston secondary diameter KN. By contrast, at the step side 116, the piston 112 has a piston main diameter KH which is greater than the piston secondary diameter KN. Owing to this varying diameter and the profile of the piston diameter between the step side 116 and the full side 114, the result is a variable, substantially non-cylindrical profile both of an outer side 112.1 and of an inner side 112.2 of the piston 112, which has the result that the piston 112 is of practically dome-like form. By means of such a design, it is the case in particular that mobility of the piston 112 within the cylinder 118 is achieved, in particular despite the wobbling movement of the piston 112.

The piston main diameter KH cannot be greater than the diameter of the cylinder 118, but it is possible, and even expedient, if the diameter of the outer side 138.1 of the seal 138 is greater than the piston main diameter KH and also than the diameter of the cylinder 118. In this way, it is made possible for the piston 112 together with the seal 138 to produce a sealing action between the first compression space 104 and the second compression space 106, and between the second compression space 106 and the crankcase interior space 160, despite the wobbling movement of the piston 112 and openings and gaps that thus form between piston 112 and cylinder 118 and between piston 112 and web wall 111. At the same time, the movement of the piston 112 is not significantly impeded or blocked despite the relatively large diameter of the outer side 138.1 of the seal 138, because the seal 138 is preferably formed from an elastic material.

FIG. 3 is a sectional illustration of a compressor 100 according to the concept of the invention in the installed state. A drive shaft 102 is arranged such that one end of the drive shaft 102 is situated within the compressor casing 154 by virtue of the corresponding end portion of the drive shaft 102, supported by a drive shaft bearing 150, being led through an opening into the compressor casing 154.

An eccentric 132 is fastened to that end portion of the drive shaft 102 which is led into the compressor casing 154. Said eccentric 132 has a cylindrical connecting-rod receiving portion 156, to which the connecting-rod bearing 152 is fastened. The axis of rotation of the cylindrical connecting-rod receiving portion 156 is arranged parallel to the axis of rotation of the drive shaft 102, but with a certain offset that is necessary to realize the eccentric action or to attain a deflection H.

The eccentric 132 furthermore has a counterweight portion 158 which is arranged opposite the connecting-rod receiving portion 156 in a radial direction. The counterweight portion 158 serves in particular for the compensation or at least partial canceling-out of inertial forces that act on the eccentric 132 via the connecting rod 128 connected to the eccentric 132 owing to the rotational movement.

The connecting rod 128 is rotatably connected to the connecting-rod receiving portion 156 via a connecting-rod bearing 152. Owing to the deflection caused by the rotational movement of the eccentric 132, that movement component of the deflection which is oriented parallel to the cylinder axis of the cylinder 118 causes an oscillating reciprocating movement of the piston 112 within the cylinder 118.

The piston 112 bears, on its step side 116, a seal 138 for sealing off the second compression space 106 with respect to the first compression space 104 or with respect to the surroundings.

In this illustration, the piston 112 is illustrated practically at the top dead center, that is to say with a first compression space 104 which has its approximately minimum volume and with a second compression space 106 which has its approximately maximum volume.

The shape of the piston 112 is, in the present case, of practically dome-shaped form, such that the piston is of matching form with respect to a dome-shaped portion 164 of the cylinder 118. This means in particular that both the inner cross section 112.2 and the outer cross section 112.1 of the piston are of varying form in an axial direction of the piston 112, in particular such that the two cross sections 112.1, 112.2 decrease along a piston axis A over the course from the step side 116 to the full side 114; in particular, the diameter becomes smaller. Such a form of the piston 112 leads to the advantage that the wobbling movement of the piston 112 can be compensated in a particularly effective manner, and in particular sealing of the two compression spaces 104, 106 with respect to one another and with respect to the crankcase interior space 160 can be achieved despite the wobbling movement, and there is nevertheless no risk of jamming of the piston 112. This is achieved through the fact that the piston has its greatest radial extent, that is to say its greatest outer cross section 112.1, at the axial level of the seal 138. Furthermore, this region of the largest outer cross section has a small axial height, that is to say the portion with the greatest outer diameter or with contact with respect to the inner wall of the cylinder 118 is kept relatively shallow. In this way, the friction and in particular the risk of jamming of piston and cylinder are minimized, despite the wobbling movement. Also, elastic deformability of the seal 138 has the effect that openings, in particular sickle-shaped gaps, that form between the piston 112 and the cylinder 118 during the wobbling movement can be sealed off by the seal 138.

Aside from a dome-shaped form of the piston, this advantageous reduction of the risk of jamming may also be achieved with other structural forms that narrow toward the full side of the piston, for example by means of a conical or similar external form.

Analogously, the piston 112 is also, on its inner side, that is to say at the inner cross section 112.2, in contact with the web wall 111 of the cylinder inner web 110 only via the seal 138. Owing to this smallest radial extent of the inner cross section 112.2 only in the axial region of the seal 138, it is the case—analogously to the outer cross section 112.1—that a low level of friction and a relatively low risk of jamming, in particular during a wobbling movement of the piston, are ensured.

The present hollow form of the piston also leads to an advantageously space-saving structural form, in particular because the interior space of the dome offers movement space for the web wall 111 which moves relative to the cylinder, and in this way the first compression space 104 and the second compression space 106 have a smaller spacing along the piston axis A. Also illustrated is the air feed port 120 which, in this embodiment, is arranged within the compressor casing 154 and which leads to the first compression space 104. The compressed-air outlet 124, which is likewise arranged within the compressor casing 154, connects the second compression space 106 to the compressed-air supply installation 200. The compressed air compressed in the second compression space 106 is thus made available via the compressed-air outlet 124.

FIG. 4A shows a detailed view of a piston 112 in a yet further embodiment in a section plane perpendicular to the drive axis. The features shown in said figure correspond substantially to the features already symbolically illustrated in FIG. 2A, and accordingly, identical or similar features or features with identical or similar function are denoted by the same reference designations.

In the present case, the shape of the piston 112 is likewise practically of dome-shaped form, such that the piston is of matching form with respect to a dome-shaped portion 164 of the cylinder 118. The piston 112 has an outer side 112.1 and an inner side 112.2. In particular—analogously to the embodiment shown in FIG. 3—the piston 112 is, owing to its dome-shaped form and despite its wobbling kinematics, suitable for moving in an interior space of a cylinder 118 which is of predominantly cylindrical or—as in the present case here—dome-shaped form.

It is furthermore possible to clearly see the seal 138 with an outer side 138.1 and an inner side 138.2. Here, the outer side 138.1 is in encircling contact over the outer circumference of the seal 138 with a cylinder inner wall 119, such that a pressure-tight seal with respect to a first compression space 104 is realized. The inner side 138.2 of the seal 138 is in encircling contact over the inner circumference of the seal 138 with a web wall inner side 109, such that a pressure-tight seal with respect to a crankcase interior space 160 is realized. Furthermore, in the present case, the piston 112, in particular the dome portion 164 of the piston 112, is fastened by means of a piston screw 166 to a connecting rod 128. Of the connecting rod 128, only the piston side 128.1 is visible in the present view.

FIG. 4B shows a detail view of a piston 112 of the yet further embodiment in a section plane parallel both to the drive axis and to the piston axis. By contrast to the view in FIG. 4A, it is possible to see in particular also a check valve 130, an air feed port 120, a connecting line 122, an air feed valve flap 142, a connecting valve flap 144, a charging valve flap 146 and a compressed-air outlet 124 and a charging port 126. These features substantially correspond to the features already symbolically illustrated in FIG. 2B—accordingly, identical or similar features or features with identical or similar function are denoted by the same reference designations.

One difference in relation to the embodiment illustrated in FIG. 2B consists in that the air feed valve flap 142 and the check valve 130 are not, as illustrated in FIG. 2B, connected jointly to an air feed port 120 leading through a connecting rod 128, but are rather arranged separately in the piston 112 and are connected—or, in the case of the check valve 130, are connectable in a manner dependent on the spring force—in gas-conducting fashion to a crankcase interior space 160.

Figure 5C:
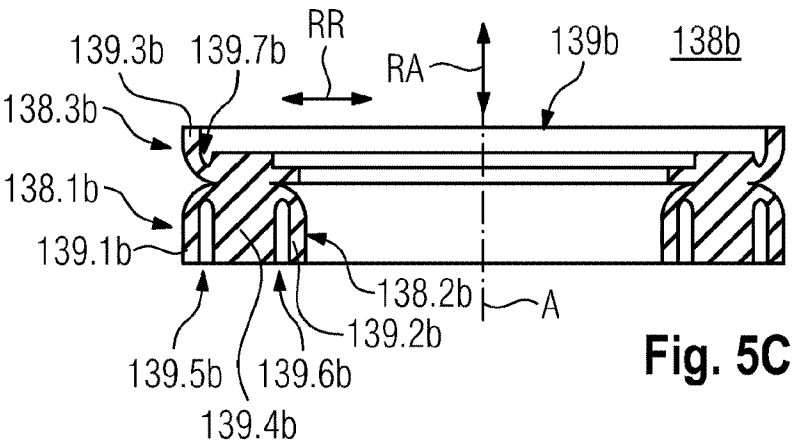
FIGS. 5C, 5D show a first refinement of a seal for a compressor.
Figure 5D:
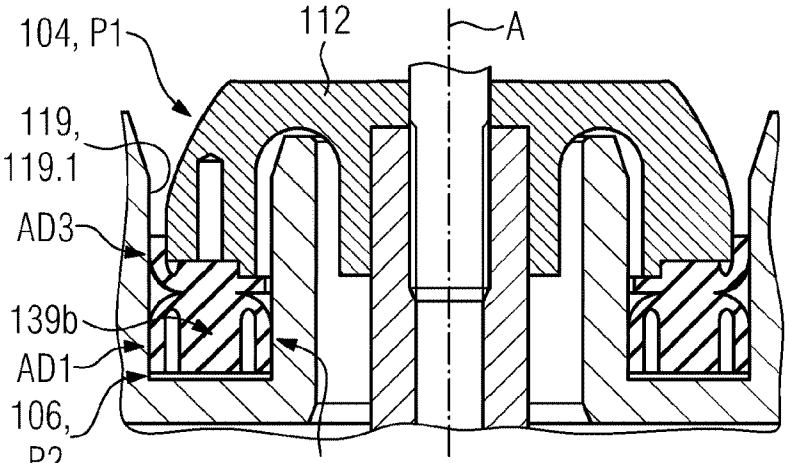
Figure 5A:
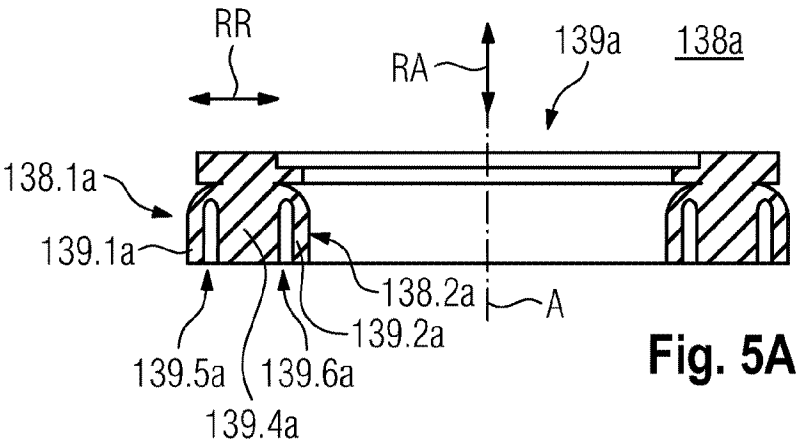
FIGS. 5A, 5B show a first refinement of a seal for a compressor.
Figure 5B:
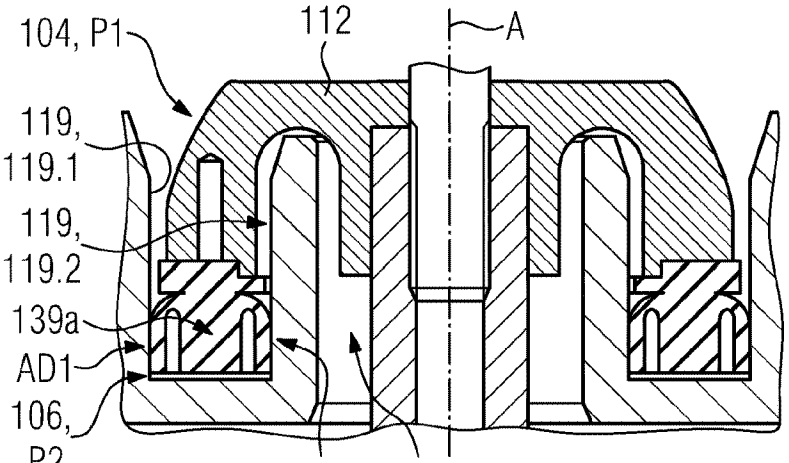

FIG. 5A and FIG. 5B show an embodiment of a seal 138*a* which substantially corresponds to an above-described seal 138. The seal 138*a* comprises a seal body 139*a*, which has a first annular lip 139.1*a* and a second annular lip 139.2*a*. The first annular lip 139.1*a* is arranged in a radial direction RR at the outside on the seal body 139*a* so as to extend in an axial direction RA in the direction of a second compression space 106. The first and/or second annular lip 139.1*a*, 139.2*a* has, in particular, a free end which is arranged in the second compression space 106.

The second annular lip 139.2*a* is arranged in a radial direction RR at the inside on the seal body 139*a*. It, too, extends in an axial direction RA in the direction of the second compression space 106. The seal body 139*a* is fastened to a step side 116 of a piston 112—this is illustrated in FIG. 5B.

The first annular lip 139.1*a* is of a rotationally symmetrical form about the piston axis A and has a profile which—proceeding from a main body 139.4*a*—extends initially in the radial direction RR outward and then changes its direction through approximately 90° so as to extend in the axial direction RA in the direction of the second compression space 106, specifically such that an outer side 138.1*a* of the seal 138*a* is arranged substantially parallel to the cylinder inner wall 119, specifically to a wall outer side 119.1 of the cylinder inner wall 119. By means of this profile, a first expansion space 139.5*a* is formed between the main body 139.4*a* and the first annular lip 139.1*a*.

The second annular lip 139.2*a* is likewise of a rotationally symmetrical form about the piston axis A and has a profile which—proceeding from the main body 139.4*a*—extends initially in the radial direction RR inward and then changes its direction through approximately 90° so as to extend in the axial direction RA in the direction of the second compression space 106, specifically such that an inner side 138.2*a* of the seal 138*a* is arranged parallel to the cylinder inner wall 119, specifically to a wall inner side 119.2 of the cylinder inner wall 119. By means of this profile, a second expansion space 139.6*a* is formed between the main body 139.4*a* and the second annular lip 139.2*a*.

By means of the first and the second expansion space 139.5*a*, 139.6*a*, it is effected that the first and the second annular lip 139.1*a*, 139.2*a* are pressed against the cylinder inner wall 119 by a second pressure P2 prevailing in the second compression space 106, and thus effect sealing of the second compression space 106 both with respect to the first compression space 104 and with respect to the crankcase interior space 160. Here, the first expansion space 139.5*a* has the effect that the first annular lip 139.1*a* is pressed against the wall outer side 119.1, which leads to a first seal AD1. The first seal AD1 exists for as long as the second pressure P2 is higher than or equal to a first pressure P1 prevailing in the first compression space 106. The second expansion space 139.6*a* has the effect that the second annular lip 139.2*a* is pressed against the wall inner side 119.2, which leads to a second seal AD2. The second seal AD2 exists for as long as the second pressure P2 is higher than an external pressure PA prevailing in the crankcase interior space 160.

FIG. 5C and FIG. 5D show a further embodiment of a seal 138*b*. The major difference between the seal 138*b* and the seal 138*a* shown in FIGS. 5A and 5B consists in that a seal body 139*b* of the seal 138*b*—aside from a first annular lip 139.1*b* and a second annular lip 139.2*b*—has an additional, third annular lip 139.3*b*, which is arranged in a radial direction RR at the outside on the seal body 139*b* and is directed in an axial direction RA toward the first compression space 104. The third annular lip 139.3*b* has in particular a free end which is arranged in the first compression space 104.

The third annular lip 139.3*b* is of rotationally symmetrical form about the piston axis A and has a profile which—proceeding from a main body 139.4*b*—extends initially in the radial direction RR outward and then changes its direction through approximately 90°, so as to extend in the axial direction RA in the direction of the first compression space 104, specifically such that an outer side 138.3*b* of the seal 138*b* is arranged substantially parallel to the cylinder inner wall 119, specifically to a wall outer side 119.1 of the cylinder inner wall 119. By means of this profile, a third expansion space 139.7*b* is formed between the main body 139.4*b* and the third annular lip 139.3*b*.

By means of the third expansion space 139.7*b*, it is effected that the third annular lip 139.3*b* is pressed against the cylinder inner wall 119 by a first pressure P1 prevailing in the first compression space 104, and sealing of the first compression space 104 with respect to the second compression space 106 is thus effected.

Here, the third expansion space 139.7*b* has the effect that the third annular lip 139.3*b* is pressed against the wall outer side 119.1 by the first pressure P1, which leads to a third seal AD3. Such a refinement with a third annular lip 139.3*b* has the advantage that the first seal AD1 and the third seal AD3 exist independently of a pressure difference between the first pressure P1 and the second pressure P2. A reliable seal between the first compression space 104 and the second compression space 106 can thus be realized. In particular—by contrast to the exemplary embodiment shown in FIGS. 5A and 5B—, sealing between the first compression space 104 and the second compression space 106 can be realized even when a first pressure P1 in the first compression space 104 is equal to or higher than a second pressure P2 in the second compression space 106. This is the case in particular in the case of a single-stage operating mode of a compressor

100, that is to say an operating mode in which air is compressed to the same pressure in both compression spaces 104, 106.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE DESIGNATIONS (PART OF THE DESCRIPTION)

1 Overall compressed-air feed
2 Compressed-air port, first compressed-air port
2' Second compressed-air port
3 Ventilation port
10 Compressed-air feed
30 Pneumatic main line
31 First isolating valve
32 Check valve
33 Bypass line
34 Throttle
35 Ventilation line
36 Further isolating valve
37 Pneumatic line
38 Yet further isolating valve
39 Further check valve
40 Further pneumatic line
41 Second isolating valve
51 Intake line
52 Filter
100 Compressor
102 Drive, drive shaft
104 First compression space, first compression chamber
106 Second compression space, second compression chamber
109 Web wall inner side
110 Cylinder inner web
111 Web wall
112 Piston, piston which can be subjected to pressure on both sides
112.1 Outer cross section, outer side of the piston
112.2 Inner cross section, inner side of the piston
113 First face side of the piston
114 Full side
115 Second face side of the piston
116 Step side
118 Cylinder
119 Cylinder inner wall
119.1 Wall outer side of the cylinder inner wall
119.2 Wall inner side of the cylinder inner wall
120 Air feed port
122 Connecting line
124 Compressed-air outlet
126 Charging port
128 Connecting rod
128.1 Piston side of the connecting rod
128.2 Drive side of the connecting rod
130 Check valve
131 Rotating part of the drive
132 Eccentrically arranged shaft portion, eccentric
138 Seal
138.1 Outer side of the seal
138.2 Inner side of the seal
139, 139*a*, 139*b* Seal body
139.1*a*, 139.1*b* First annular lip
139.2*a*, 139.2*b* Second annular lip
139.3*b* Third annular lip
139.4*a*, 139.4*b* Main body of the seal body
139.5*a*, 139.5*b* First expansion space
139.6*a*, 139.6*b* Second expansion space
139.7*b* Third expansion space
142 Air feed valve flap
144 Connecting valve flap
146 Charging valve flap
150 Drive shaft bearing
152 Connecting-rod bearing
154 Compressor casing
156 Connecting-rod receiving portion
158 Counterweight portion
160 Crankcase interior space
162 Rotatable connection
164 Dome portion of the cylinder
166 Piston screw
200 Compressed-air supply installation
210 Air spring
211 Air bellows, bellows
212 Air spring valve
220 Gallery, gallery line
221 Spring branch line
222 Air dryer
224 Pressure medium reservoir, accumulator
230 Stress-pressure sensor
300 Pneumatic system
400 Vehicle
410 Bearing
500 Pneumatic installation
A Piston axis
AD1 First seal
AD2 Second seal
AD3 Third seal
B Ventilation direction
D Component, perpendicular to the stroke direction, of the offset
E Ventilation direction
E' Further ventilation direction
F Spring force of the check valve
H Deflection, deflection of the piston in the stroke direction
KH Piston main diameter KN Piston secondary diameter
M Motor
P1 First pressure, pressure in the first compression space
P2 Second pressure, pressure in the second compression space
PA External pressure, pressure in the crankcase interior space
RA Axial direction
RR Radial direction
S1 Axis of rotation of the drive, point S1
S2 Axis of rotation of the rotatable connection between connecting rod and eccentrically arranged shaft portion, point S2
U Surroundings

The invention claimed is:

1. A compressor for a compressed-air feed of a compressed-air supply installation, for operating a pneumatic installation, comprising:
- a cylinder comprising a rotationally symmetrical cylinder inner web that extends radially inward from a cylinder inner wall of the cylinder, the cylinder inner web comprising a web wall having a web wall inner side;
- a first compression space;
- a second compression space;
- an air feed port;
- a compressed-air outlet; and
- a piston having a first face side, which is subjectable to pressure and which is directed toward the first compression space, and a second face side, which is situated opposite the first face side and which is subjectable to pressure and which is directed toward the second compression space, the first compression space being delimited by the first face side and the second compression space being delimited by the second face side,
- wherein the first face side comprises a full side and the second face side comprises a step side,
- wherein the piston is attached via a connecting rod to a drive,
- wherein the first compression space and the second compression space are connected to one another via a connecting line,
- wherein the connecting rod is connected rigidly at a piston side to the piston and, at a drive side, is connected rotatably to a rotating part of the drive, and
- wherein the piston bears, on the step side, on at least one seal which seals off the first compression space and the second compression space.

2. The compressor as claimed in claim 1, wherein the piston comprises a check valve configured to open automatically, counter to a spring force, from the first compression space in a direction of the air feed port.

3. The compressor as claimed in claim 1, wherein the connecting rod is rotatably connected to the rotating part of the drive in a form of an eccentrically arranged shaft portion.

4. The compressor as claimed in claim 1, wherein the connecting rod comprises a single piece with the piston and without articulation with respect to the piston.

5. The compressor as claimed in claim 1, wherein the first compression space is of cylindrical form or is of cylindrical form with a dome-shaped portion, and/or the second compression space is of annular cylindrical form.

6. The compressor as claimed in claim 1, wherein the seal is configured to seal off the second compression space with respect to a crankcase interior space and/or with respect to surroundings.

7. The compressor as claimed in claim 1, wherein the at least one seal on the step side of the piston provides pressure-tight sealing, which acts in a radial direction, both against an outer side and against an inner side, and
- wherein the at least one seal comprises a single seal.

8. The compressor as claimed in claim 7, wherein the outer side of the seal is in encircling contact with the cylinder inner wall, and the inner side of the at least one seal is in encircling contact with the web wall inner side.

9. The compressor as claimed in claim 7, wherein the seal comprises an annular seal body with a first annular lip radially at an outside on the seal body and with a second annular lip radially at an inside on the seal body.

10. The compressor as claimed in claim 7, wherein the seal comprises an annular seal body, having:
- a first annular lip, which is arranged in a radial direction at an outside on the seal body so as to be directed in an axial direction toward the second compression space, and/or
- a second annular lip, which is arranged in the radial direction at an inside on the seal body so as to be directed in the axial direction toward the second compression space.

11. The compressor as claimed in claim 10, wherein the annular seal body comprises a third annular lip which is arranged in the radial direction at the outside on the seal body so as to be directed in the axial direction toward the first compression space.

12. The compressor as claimed in claim 1, wherein the piston comprises a non-cylindrical outer cross section which varies in an axial direction.

13. The compressor as claimed in claim 1, wherein the second compression space comprises a charging port configured for additional feed of compressed air from a pressure medium reservoir.

14. The compressor as claimed in claim 1, wherein the air feed port is arranged within the connecting rod and/or the piston.

15. The compressor as claimed in claim 1, wherein the rotatable connection between connecting rod and an eccentrically arranged shaft portion of the drive comprises a connecting-rod bearing comprising a plain bearing, ball bearing, or a needle-roller bearing.

16. A compressed-air supply installation for operating a pneumatic installation, comprising:
- an air feed;
- the compressor as claimed in claim 1, connected to the air feed via an air feed port;
- a pneumatic main line pneumatically connected to the compressor via a compressed-air outlet, the pneumatic main line comprising an air dryer, the pneumatic main line being connected to a compressed-air port of a gallery; and
- a pressure medium reservoir pneumatically connected to the compressor via a charging port.

17. A method for operating the compressed-air supply installation as claimed in claim 16, comprising:
- compressing air from a crankcase interior space and/or from surroundings to a low pressure level in a first compression space of the compressor;
- further compressing the compressed air that has been compressed to a low pressure level in the first compression space to a high pressure level in a second compression space of the compressor; and
- feeding the compressed air that has been compressed to a high pressure level in the second compression space from the compressed-air outlet via a pneumatic main line to a compressed-air port of a gallery via an air dryer.

18. A vehicle having the compressed-air supply installation as claimed in claim 16.

19. The compressor as claimed in claim 1, wherein the compressor comprises a compression blower.

20. The compressor as claimed in claim 1, wherein the connecting rod is connected rigidly and without articulation at the piston side to the piston.

* * * * *